US007044064B2

(12) United States Patent
Li

(10) Patent No.: US 7,044,064 B2
(45) Date of Patent: May 16, 2006

(54) UMBRELLA TABLE WITH INLAID TURNTABLE

(75) Inventor: Jun Li, Summerfield, NC (US)

(73) Assignee: Hanamint Corporation, Inc., Greensboro, NC (US)

( * ) Notice: Subject to any disclaimer, the term of this patent is extended or adjusted under 35 U.S.C. 154(b) by 0 days.

(21) Appl. No.: 10/641,873

(22) Filed: Aug. 15, 2003

(65) Prior Publication Data

US 2005/0034638 A1 Feb. 17, 2005

(51) Int. Cl.
*A47B 37/00* (2006.01)

(52) U.S. Cl. ..... 108/50.12

(58) Field of Classification Search ..... 108/94, 108/103, 104, 50.12, 50.11; 135/99, 98, 135/16

See application file for complete search history.

(56) References Cited

U.S. PATENT DOCUMENTS

| | | | | |
|---|---|---|---|---|
| 18,042 | A | 8/1857 | Farrar et al. | |
| 464,073 | A | 12/1891 | Howell | |
| 528,250 | A | 10/1894 | Graham | |
| 545,812 | A | 9/1895 | Oakes | |
| 705,903 | A | 7/1902 | Bullock | |
| 872,256 | A | 11/1907 | Schackner | |
| 958,672 | A | 5/1910 | Olson | |
| 1,077,218 | A | 10/1913 | Bryant et al. | |
| 1,114,129 | A * | 10/1914 | Gage | 108/104 |
| 1,344,900 | A | 6/1920 | Juresisin | |
| 2,495,250 | A | 1/1950 | Gilly | |
| 2,570,634 | A * | 10/1951 | Bartschy | 108/104 |
| 2,591,215 | A * | 4/1952 | Thiel | 108/104 |
| 2,877,827 | A * | 3/1959 | Anderson | 108/50.12 |
| 4,334,482 | A | 6/1982 | Bolduc | |
| 4,450,774 | A | 5/1984 | Weaver | |
| 4,782,764 | A * | 11/1988 | Robinson | 108/104 |
| 5,335,803 | A | 8/1994 | O'Brien et al. | |
| 5,493,976 | A * | 2/1996 | Hammond | 108/50.12 |
| 5,848,712 | A | 12/1998 | Weir | |
| 6,065,466 | A * | 5/2000 | Baykal | 108/50.12 |
| D453,263 | S | 2/2002 | Wogan | |
| 6,463,946 | B1 | 10/2002 | Wu | |
| 2002/0162490 | A1 | 11/2002 | Petryna | |

OTHER PUBLICATIONS

Dining Table and Chairs with Flush Mounted Lazy Susan, Masterpiece Furniture Creations, website printout dated Apr. 24, 2003, believed to be available as of filing date.

* cited by examiner

*Primary Examiner*—Jose V. Chen
(74) *Attorney, Agent, or Firm*—Womble Carlyle Sandridge & Rice, PLLC

(57) ABSTRACT

An umbrella table with an inlaid turntable is disclosed. The table includes a tabletop having a substantially planar top surface with a circular aperture therein. A disc is rotatably mounted in the circular aperture. The disc has a substantially planar upper surface and a central opening therethrough. The top surface of the tabletop and the upper surface of the disc are substantially coplanar, and the central opening is capable of receiving a cylindrical shaft such as the shaft of an umbrella.

22 Claims, 5 Drawing Sheets

UMBRELLA TABLE WITH INLAID TURNTABLE

FIELD OF THE INVENTION

The invention relates to tables, and more particularly relates to an umbrella table having an inlaid turntable or "Lazy Susan" that is substantially flush with a stationary top surface of the table and includes an umbrella-receiving bore therethrough.

BACKGROUND

Umbrella tables are a common type of outdoor furniture. Umbrella tables typically include a stationary tabletop having a central opening for receiving a shaft or pole of an umbrella. The umbrella pole extends through the central opening in the tabletop such that the hood portion of the umbrella substantially shields the underlying tabletop and some or all of its occupants from sun and weather. An umbrella base typically is positioned below the central opening in the tabletop to receive and support the lower end of the umbrella pole. The portions of the tabletop that surround the umbrella pole are available for supporting various articles such as dishes and flatware for dining. Because umbrella tables are used outdoors, umbrella tables are typically constructed of weather resistant materials such as metal and glass. In recent years, decorative cast aluminum umbrella tables increasingly have become popular.

Indoor "self-waiting" tables are also known. Such self-waiting tables are typically constructed of wood, and include integral turntables or "Lazy Susans" mounted at or near their centers. One such self-waiting table is disclosed in U.S. Pat. No. 958,672. The integrally-mounted turntable permits items of food or the like to be placed on the turntable and moved from one location on the table to another as desired for convenient and easy access to persons positioned around the table. While such tables can be useful, such tables are not suited for extensive outdoor use, and do not provide a means for supporting an umbrella for shielding an underlying table and its occupants from sun and weather.

Others have attempted to provide a turntable for use with an umbrella table by providing a separate turntable that sits atop a tabletop and includes a central bore for passing a shaft of an umbrella therethrough. Such turntables can be positioned directly over a central opening in an umbrella table such that an umbrella pole can be inserted through both the turntable and the aligned opening in the tabletop. One such turntable is disclosed in U.S. Pat. No. 6,463,946. Others have provided rotatable trays that mount on and around a portion of an umbrella pole that extends above a tabletop of an umbrella table. One such rotatable tray is disclosed in U.S. Pat. No. 5,848,712. Unfortunately, such turntables and rotating shelves or trays can interfere with the use of the stationary top surface of an umbrella table. In particular, such turntables and shelves decrease the amount of useful stationary surface area on an umbrella table. In addition, because such turntables and shelves protrude above the upper surfaces of their underlying tabletops, these items can actually interfere with passing items directly between persons seated on opposite sides of an umbrella table when such persons do not desire to use a turntable or rotating shelf to pass such items. Furthermore, such after-market turntables and rotating shelves can detract from the ornamental appearance of an umbrella table.

Therefore, there is a need for an umbrella table and turntable in which the turntable does not detract from the useful surface area of the table. In addition, there is a need for a turntable that is visually compatible with the ornamental appearance of an ornamented umbrella table. Further, there is a need for a turntable and umbrella table wherein the turntable does not protrude above the top surface of the table, and therefore does not provide an obstacle between opposite sides of the table.

SUMMARY

The invention includes a table including a tabletop having a substantially planar top surface with a circular aperture therein. The table also includes a disc that is rotatably mounted in the circular aperture. The disc includes a substantially planar upper surface and a central opening therethrough. The top surface of the tabletop and the upper surface of the disc are substantially coplanar, and the central opening is capable of receiving a cylindrical shaft such as an umbrella pole.

The invention also includes an umbrella table with a tabletop having a substantially planar top surface. The umbrella table also includes a turntable having a substantially planar upper surface and a central bore therethrough. The upper surface of the turntable is substantially flush with the top surface of the tabletop. The central bore is sized and configured to receive an umbrella pole, and the turntable is substantially free to rotate when the umbrella pole is received in the central bore.

The invention further includes an umbrella table with a tabletop having a first surface portion, a second surface portion that is substantially coplanar with the first surface portion, and an umbrella-receiving opening. The umbrella table further includes means for rotating the second surface portion relative to the first surface portion.

These and other aspects of the invention will be evident from a reading of the following descriptions of embodiments of the invention together with the drawings.

DETAILED DESCRIPTION

Figure 1:
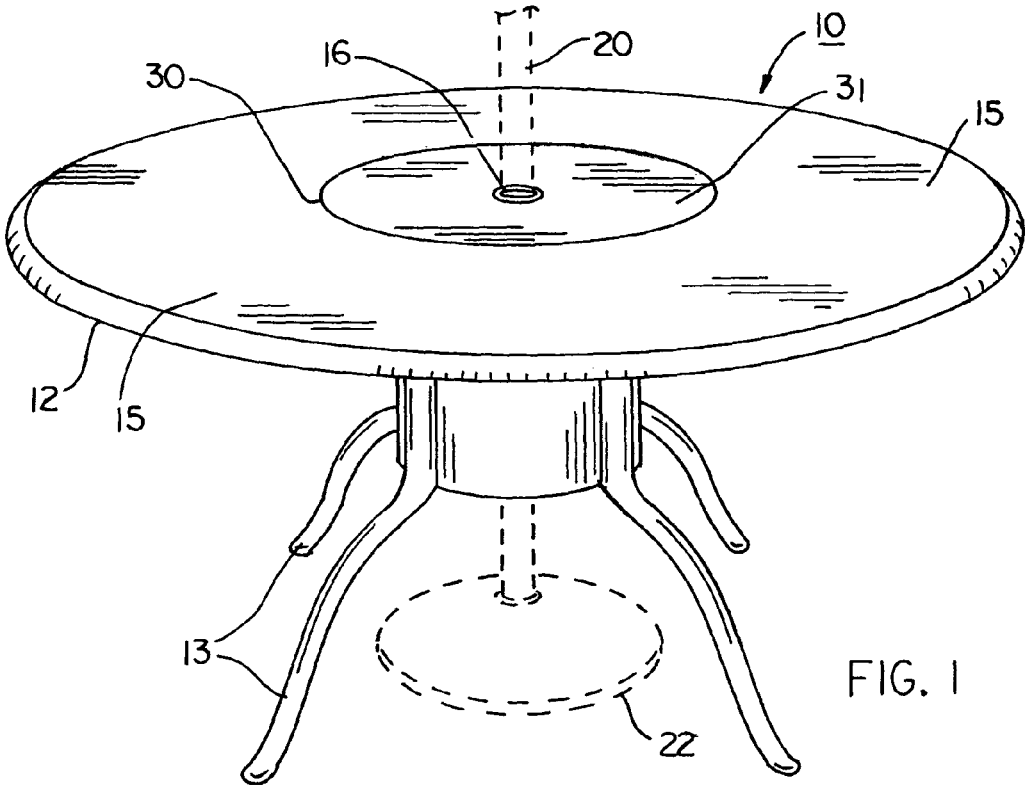
FIG. 1 is a perspective view of one embodiment of an umbrella table according to the invention.

FIG. 1 shows one embodiment of a table 10 according to the invention. The table 10 includes a tabletop 12 and an underlying table support 13. The upper surface 15 of the tabletop 12 is substantially flat, and may have any desired outer shape. For example, the tabletop 12 may be circular as shown. Alternatively, the table 10 may be square, rectangular, oval, or the like. The table support 13 can be configured in any manner that stably supports the tabletop in an elevated position. Preferably, the table support 13 has a substantially open center and permits an umbrella stand 22 to be positioned beneath the table 10 as shown. The tabletop 12 includes a central aperture or recess 14. The aperture 14 is sized and shaped to receive a turntable or disc 30 as shown. The turntable 30 includes a central opening 16 for receiving a shaft 20 of an umbrella. The table 10 is desirably configured such that the umbrella shaft 20 can fully pass through the central opening 16 and extend to an underlying umbrella stand 22 as shown.

As shown in FIG. 1, the upper surface 15 of the tabletop 12 and the top surface 31 of the turntable 30 are substantially coplanar such that the surfaces 15, 31 are substantially flush with each other. Accordingly, when the turntable 30 is not used, the turntable 30 does not diminish the surface area of the table 10 or interfere with the continuity of the table's surface.

Figure 2:
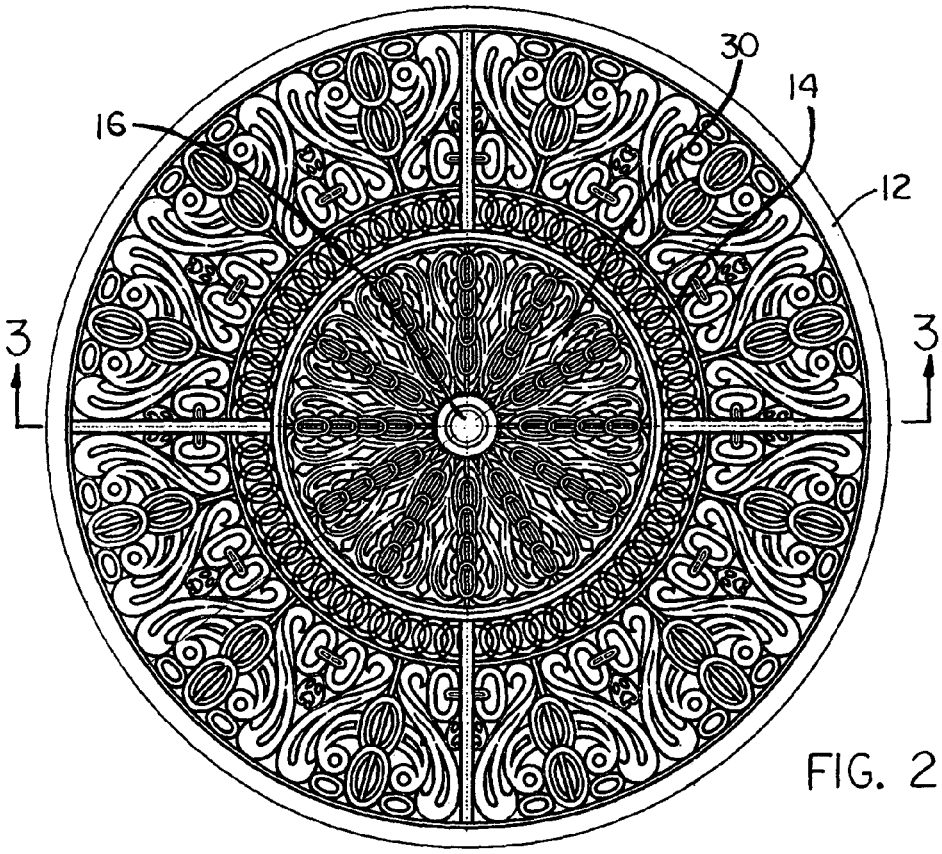
FIG. 2 is a top plan view of the umbrella table shown in FIG. 1.
Figure 3:
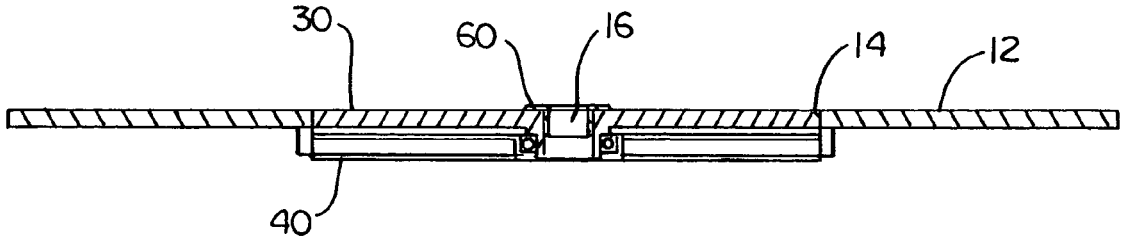
FIG. 3 is a cross-sectional view of the tabletop portion of the umbrella table shown in FIGS. 1 and 2 taken along line 3—3 as shown in FIG. 2.

As shown in FIGS. 2 and 3, the turntable or disc 30 is received in a disc-receiving aperture or recess 14 in the tabletop 12. The aperture 14 desirably is centered in the tabletop 12 as shown, though the aperture 14 may be located elsewhere in the tabletop 12 if desired. The turntable 30 is received in the aperture 14. Preferably, the aperture 14 is only slightly larger in diameter than the turntable 30 such that the radial gap between the tabletop 12 and turntable 30 is minimized. A central opening 16 extends through the turntable 30 as shown. The central opening 16 is sized to receive shafts of conventional patio umbrellas that typically range in diameter from about 1.38 to about 2 inches. Desirably, the opening 16 is at least about 2 inches in diameter.

Figure 4:
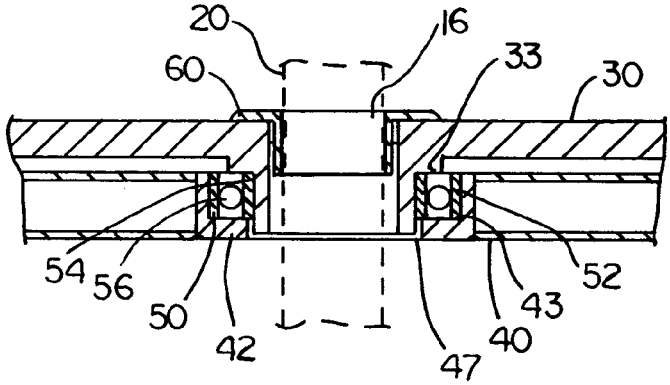
FIG. 4 is a detail of the center portion of the cross-sectional view of FIG. 3.
Figure 6:
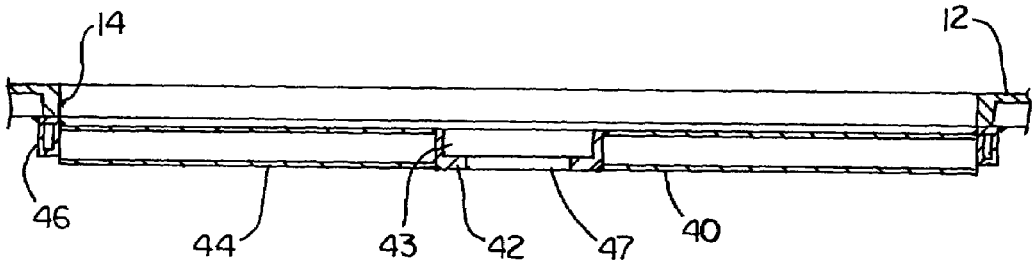
FIG. 6 is a detail of the center portion of the cross-sectional view of FIG. 3, shown with the bearing and turntable disc removed.
Figure 7:
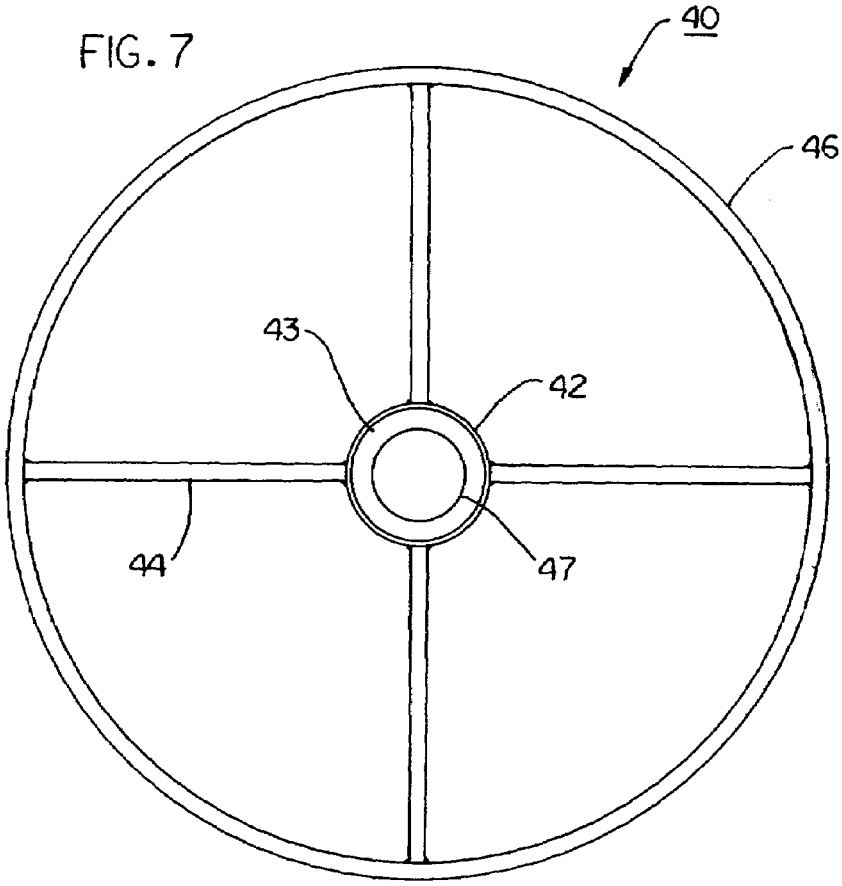
FIG. 7 is a plan view of a bearing bracket for use in an umbrella table like that shown in FIG. 1.

FIGS. 3 and 4 show one arrangement for rotatably supporting the turntable 30 in the aperture 14. In the embodiment shown, a bearing support 40 is affixed to the underside of the tabletop 12. As shown in FIGS. 4, 6, and 7, the bearing bracket 40 includes a centrally positioned hub 42. The hub 42 includes a bearing receptacle 43 and a central bore 47. One or more brace members 44 connect the hub 42 to the tabletop 12. As shown in FIG. 6, the bearing bracket 40 may include an outer support 46. The outer support may be welded or otherwise attached to the underside of the tabletop 12. As shown in FIG. 7, a plurality of brace members 44 may connect the hub 42 to the outer support 46.

Figure 5C:
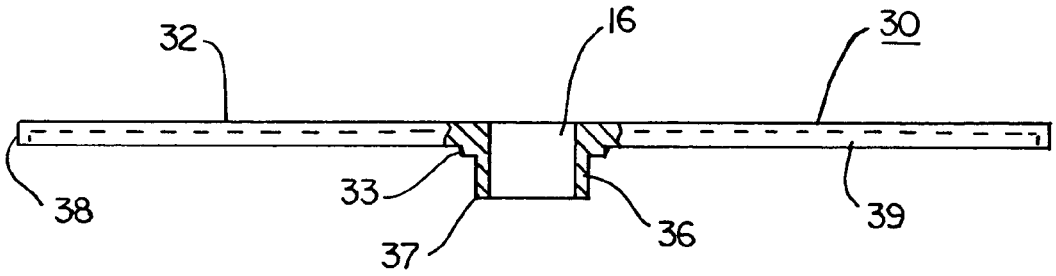
FIG. 5*c* is a side view of the turntable or disc portion shown in FIGS. 5*a* and 5*b*, shown in partial cross-section.
Figure 5A:
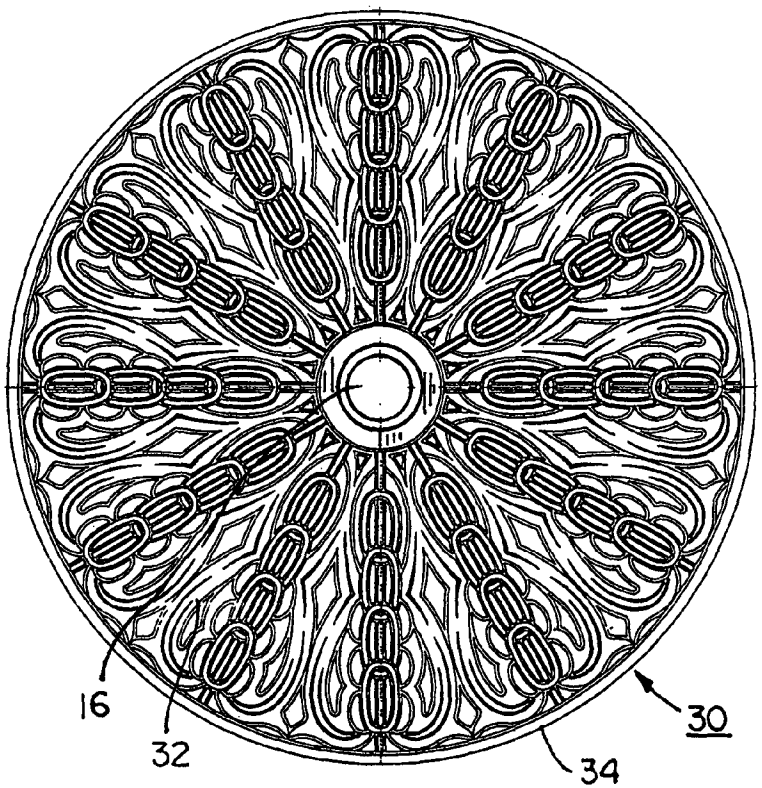
FIG. 5*a* is a top plan view of the turntable or disc portion of the umbrella table shown in FIG. 1.
Figure 5B:
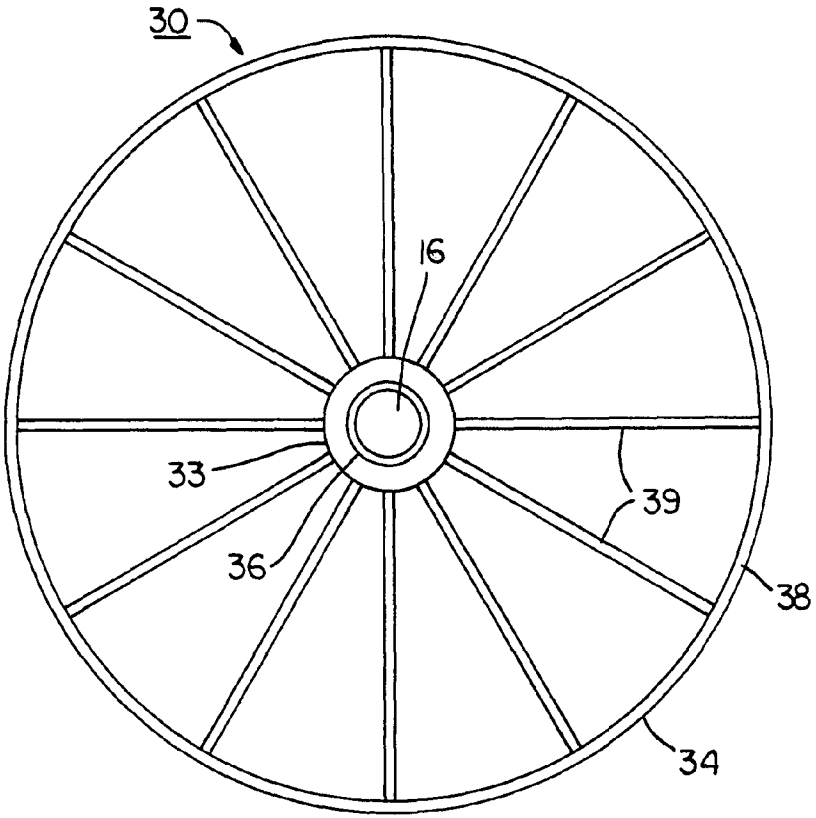
FIG. 5*b* is a bottom plan view of the turntable or disc portion shown in FIG. 5*a;*
Figure 8:
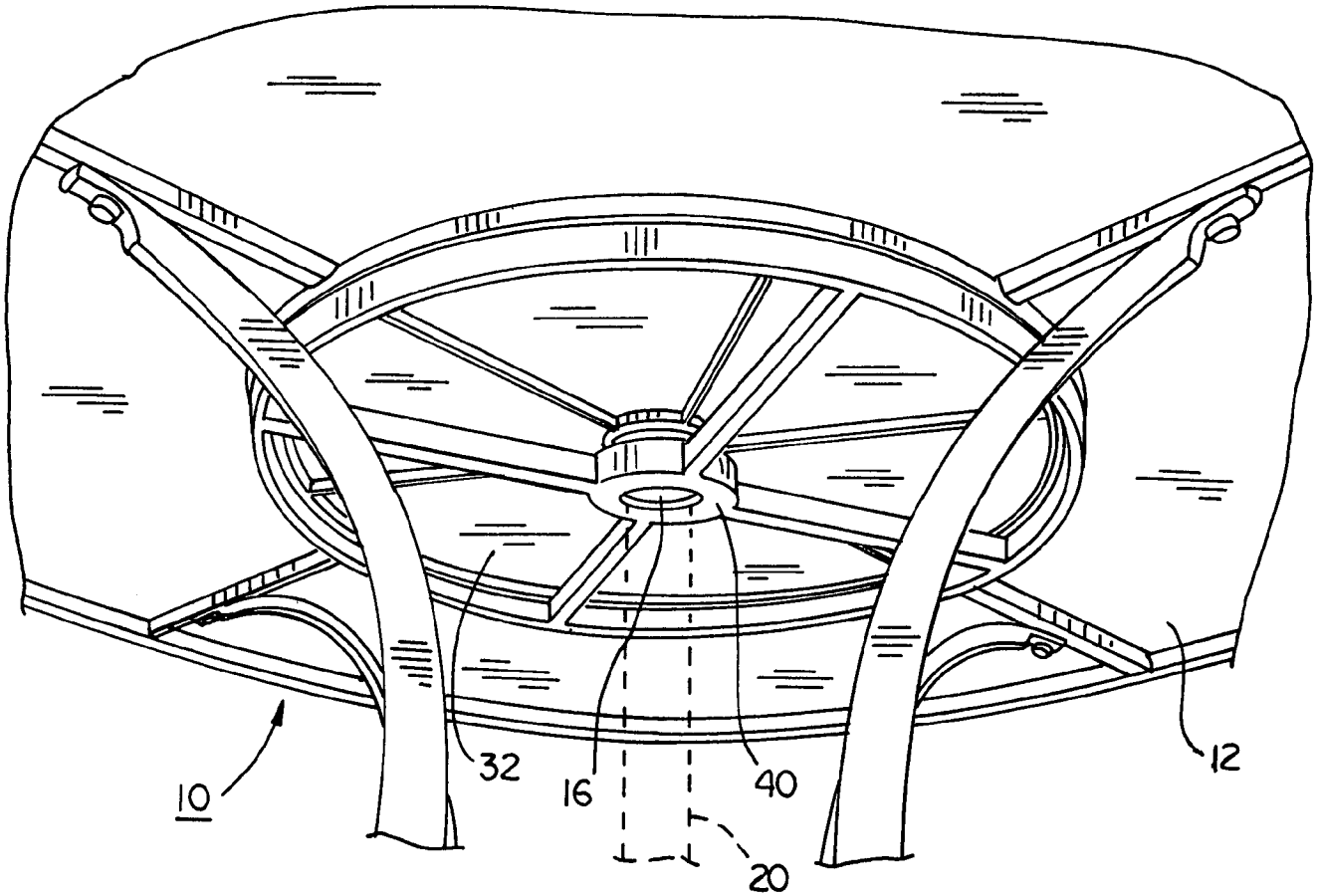
FIG. 8 is a partial perspective view of the underside of the umbrella table shown in FIG. 1.

As shown in FIG. 4, a bearing such as a ball bearing assembly 50 is nested in the bearing receptacle 43 in the hub 42. The bearing assembly 50 may include an outer race 52, an inner race 54, and a plurality of ball bearings 56 disposed between the inner and outer races. Preferably, the bearing assembly 50 is constructed of weather-resistant and corrosion-resistant materials such as stainless steel, brass, or the like. As shown in FIGS. 5*a*–5*c*, the turntable or disc 32 includes an outer edge 34 and a central opening 16. The underside of the turntable desirably includes a cylindrical boss 37 and a shoulder 33. A plurality of radial reinforcement ribs 39 may extend between the shoulder 33 and a rim portion 38 along the outer edge 34. As shown in FIG. 4, the boss 44 of the turntable 30 is configured to extend through the inner race 54 of the bearing assembly 50. Preferably, the outer diameter of the boss 36 is about the same size as the inner diameter of the inner race 54 such that the boss 36 securely fits inside the bearing assembly 50. In addition, as shown in FIG. 4, the shoulder 33 of the turntable 30 is sized such that the shoulder 33 rests atop the inner race 54. If desired, the bearing receptacle 43 can be sized such that the bearing assembly 50 can be pressed into the receptacle 43, thereby providing a tight, interference fit. Similarly, the boss 36 on the turntable 30 can be sized such that the boss 36 can be pressed into the bearing assembly 50 to provide a tight, interference fit. The bearing assembly 50 permits the turntable 30 to freely rotate within the aperture 14 in the tabletop 12. As shown in FIGS. 4 and 8, the central opening 16 in the turntable 30 permits a shaft 20 such as an umbrella pole to completely extend through the table 10. If desired, a collar or bushing 60 can be provided as shown in FIG. 4 to reduce the radial clearance between the shaft 20 and the walls of the opening 16. The bushing 60 can be constructed of a polymeric material, for example, thereby providing a low-friction bearing surface for the shaft 20 in the opening 16.

Preferably, the turntable 30 and tabletop 12 have matching or complementary ornamental appearances. If desired, it is possible to provide a turntable 30 and tabletop 12 with patterns and or textures that make it difficult to detect any separation between the two components. Preferably, a table according to the invention is substantially constructed of one or more materials that are resistant to degradation caused by sun, rain, moisture, heat, cold, or other weather conditions. For example, it is desirable to construct the major components of a table according to the invention of aluminum, and in particular, of cast aluminum. Alternatively, such a table may be constructed from cast iron, a polymeric material, or any other suitable material or materials.

The above description of embodiments of the invention are for the purpose of describing various aspects of the invention, are not intended to limit the scope of the invention thereto. Persons of ordinary skill in the art will understand that certain modifications may be made to the described embodiments without departing from the invention. All such modifications are within the scope of the appended claims.

What is claimed is:

1. A table comprising:

(a) a tabletop having a substantially planar top surface with a circular aperture therein;

(b) a disc rotatably mounted in the circular aperture, the disc having a substantially planar upper surface and a central opening therethrough; and (c) a support affixed to the table top to rotatably support the disc; and (d) at least one friction reducing element that facilitates rotation of the disc in the circular aperture;

(e) wherein the top surface of the tabletop and the upper surface of the disc are substantially coplanar; and the central opening is capable of receiving a cylindrical shaft.

2. A table according to claim 1 wherein the friction-reducing element is a bearing configured to rotatably support the disc in the circular aperture.

3. A table according to claim 2 wherein the bearing is substantially constructed of one or more corrosion-resistant materials.

4. A table according to claim 2 wherein the bearing includes a central bore and the disc includes a boss that is received in the bore.

5. A table according to claim 2 wherein the support is a bearing bracket affixed to an underside of the tabletop and the bearing is supported in the bearing bracket.

6. A table according to claim 5 wherein the bearing bracket comprises a hub disposed proximate to a center portion of the circular aperture in the tabletop.

7. A table according to claim 6 wherein the bearing bracket further comprises at least one brace affixing the hub to the tabletop.

8. A table according to claim 1 wherein the tabletop and disc are substantially constructed of weather-resistant materials.

9. A table according to claim 8 wherein the tabletop and disc are substantially constructed of aluminum.

10. A table according to claim 1 and further comprising a bushing in the central opening.

11. An umbrella table comprising:

(a) a tabletop having a substantially planar top surface;

(b) a turntable having a substantially planar upper surface and a central bore therethrough;

(c) a support affixed to the tabletop to rotatably support the disc; and (d) at least one friction-reducing element;

(e) wherein the upper surface of the turntable is substantially flush with the top surface of the tabletop, the central bore is sized and configured to receive an umbrella pole, the turntable is substantially free to rotate when the umbrella pole is received in the central bore, and the friction-reducing element facilitates rotation of the turntable.

12. A table according to claim 11 wherein the support includes a bearing, and the turntable is rotatably supported by the bearing.

13. A table according to claim 12 wherein the bearing is a ball bearing.

14. A table according to claim 12 wherein the bearing includes a central bore and the turntable includes a boss received in the bore.

15. A table according to claim 12 wherein the support is a bearing bracket affixed to the tabletop.

16. A table according to claim 15 wherein the tabletop includes a circular aperture having a center and the bearing bracket comprises a hub disposed proximate to the center of the circular aperture.

17. A table according to claim 16 wherein the bracket further comprises at least one brace member affixing the hub to the tabletop.

18. A table according to claim 11 wherein the tabletop and turntable are substantially constructed of one or more weather-resistant materials.

19. A table according to claim 18 wherein the tabletop and turntable are substantially constructed of aluminum.

20. A table according to claim 11 wherein the tabletop and turntable include complimentary ornamental patterns.

21. An umbrella table comprising:

(a) a tabletop having a stationary surface portion and a rotating surface portion;

(b) an opening that permits an umbrella pole to extend through the rotating surface portion; and (c) a support affixed to the stationary surface portion to rotatably support the rotating surface portion;

(d) at least one friction-reducing element that facilitates rotation of the rotating surface portion;

(e) wherein the stationary surface portion and rotating surface portion of the tabletop are substantially coplanar.

22. An umbrella table comprising:

(a) a tabletop having a first surface portion, a second surface portion that is substantially coplanar with the first surface portion, and an umbrella-receiving opening; and (b) means for rotating the second surface portion relative to the first surface portion, wherein the means for rotating comprises a support affixed to the first surface portion and rotatably supporting the second surface portion, and at least one friction-reducing element.

* * * * *

UNITED STATES PATENT AND TRADEMARK OFFICE

CERTIFICATE OF CORRECTION

PATENT NO. : 7,044,064 B2
APPLICATION NO. : 10/641873
DATED : May 16, 2006
INVENTOR(S) : Garrard et al.

It is certified that error appears in the above-identified patent and that said Letters Patent is hereby corrected as shown below:

In Claim 11, Col.5 line 16, the term disc should read turnable.

Signed and Sealed this

Twenty-ninth Day of August, 2006

JON W. DUDAS
*Director of the United States Patent and Trademark Office*